US007032398B2

(12) United States Patent
Dilk et al.

(10) Patent No.: US 7,032,398 B2
(45) Date of Patent: Apr. 25, 2006

(54) ENERGY MANAGEMENT SYSTEM, METHOD, AND APPARATUS

(75) Inventors: Wayne Dilk, Sherwood Park (CA); Harold E. Martin, Mississauga (CA)

(73) Assignee: Toromont Industries Ltd., Toronto (CA)

( * ) Notice: Subject to any disclaimer, the term of this patent is extended or adjusted under 35 U.S.C. 154(b) by 93 days.

(21) Appl. No.: 10/787,943

(22) Filed: Feb. 27, 2004

(65) Prior Publication Data

US 2005/0188710 A1 Sep. 1, 2005

(51) Int. Cl.
*A63C 19/10* (2006.01)

(52) U.S. Cl. ..... 62/235; 62/59; 62/434; 62/529

(58) Field of Classification Search ..... 62/235, 62/331, 59, 434, 529, 201, 185
See application file for complete search history.

(56) References Cited

U.S. PATENT DOCUMENTS

| | | | | | |
|---|---|---|---|---|---|
| 2,226,297 | A | | 12/1940 | Spangenberg | |
| 3,774,674 | A | | 11/1973 | McFarlan | |
| 3,831,394 | A | * | 8/1974 | Holmsten | 62/235 |
| 3,878,694 | A | * | 4/1975 | Holmsten | 62/235 |
| 4,242,872 | A | | 1/1981 | Shaw | |
| 4,467,619 | A | * | 8/1984 | Kovach | 62/235 |
| 4,656,836 | A | | 4/1987 | Gilbertson | |
| 4,700,548 | A | * | 10/1987 | Roche et al. | 62/139 |
| 4,796,437 | A | | 1/1989 | James | |
| 4,940,079 | A | | 7/1990 | Best et al. | |
| 5,054,297 | A | * | 10/1991 | Furuhama | 62/260 |
| 5,372,011 | A | | 12/1994 | O'Neal | |
| 5,678,626 | A | | 10/1997 | Gilles | |
| 5,682,752 | A | | 11/1997 | Dean | |
| 5,778,683 | A | | 7/1998 | Drees et al. | |
| 6,082,125 | A | * | 7/2000 | Savtchenko | 62/238.6 |
| 6,158,499 | A | | 12/2000 | Rhodes et al. | |
| 6,170,278 | B1 | * | 1/2001 | Jorgensen | 62/235 |
| 6,321,551 | B1 | * | 11/2001 | Backman et al. | 62/235 |
| 6,393,861 | B1 | | 5/2002 | Levenduski et al. | |
| 6,601,398 | B1 | | 8/2003 | Singh et al. | |

* cited by examiner

*Primary Examiner*—Marc Norman
(74) *Attorney, Agent, or Firm*—McCarthy Tetrault LLP

(57) ABSTRACT

An energy management system may include a refrigeration apparatus such as may be used to form an ice rink. Heat rejected from that apparatus may be used to address heating loads elsewhere. The apparatus may include a thermal storage apparatus, such as may be charged with ice, or another phase change material. The refrigeration apparatus may then be run for the purpose of obtaining the rejected heat, with the cooling of the thermal storage material as a by-product of operation to obtain extra rejected heat. The cold reservoir then developed in the thermal storage material may be used subsequently to provide cooling to a different load, at a different time of day. The thermal storage element may be used to provide cooling to a condenser of the refrigeration apparatus, or may be placed in series with a cooling load, such as an ice sheet or refrigerated enclosure. The apparatus may be electronically controlled, may used ammonia as an operating fluid in a vapor cycle system. The vapor cycle system may include a compressor, and may employ a floating head pressure on the compressor.

21 Claims, 5 Drawing Sheets

ENERGY MANAGEMENT SYSTEM, METHOD, AND APPARATUS

FIELD OF THE INVENTION

This invention relates to the field of energy management systems, methods, and apparatus, such as may, for example, include the field of ice making systems for recreational facilities such as arenas.

BACKGROUND OF THE INVENTION

Recreational facilities in mid-latitude climates may include an ice rink for winter sports such as hockey or curling, and may also include other facilities such as a swimming pool, concert hall or classrooms, dressing rooms, heated stands, showers, and so on. Up to now, ice making equipment has tended to be used to make ice, and the heat rejected in the ice making process may not necessarily have been used as advantageously as might otherwise have been possible or desirable. Arena ice making equipment has tended to be operated separately from building mechanical systems, rather than being fully integrated with them as proposed herein in a combined heating, air conditioning and refrigeration system. That being the case, in the view of the present inventors it may be advantageous to employ the rejected heat more effectively than previously. In that regard, the present inventors are of the view that it may be advantageous to employ the ice making apparatus as a heat pump to provide a source of heat for rejection, with an ice by-product that can be melted at a subsequent opportunity. That is, heating and cooling loads may not occur during the same time period, or may be unequally matched. Given that both heating and cooling loads may vary during the day, it may be advantageous to provide a large amount of rejected heat at one time of day, and a large amount of refrigeration at another. To that end the present inventors propose, as described herein, to provide an apparatus, and a method of using a thermal capacitance to address, in some measure, the timing mis-match that may occur between the heating and cooling loads.

SUMMARY OF THE INVENTION

In an aspect of the invention there is an energy management system. The energy management system includes a refrigeration apparatus. The refrigeration apparatus is operable to reject heat. A refrigeration load ice sheet apparatus is connected to the refrigeration apparatus for cooling to make an ice sheet. A thermal storage cold sink apparatus is connect to the refrigeration apparatus for cooling. A heating load apparatus is connected to be heated by the heat rejected from the refrigeration apparatus. A load management control system is operable at a first time to cause ice to be made at the refrigeration load ice sheet apparatus and to cause heat to be directed from the refrigeration apparatus to the heating load apparatus. The load management control system is operable at a second time to cause the thermal storage apparatus to be charge as a cold sink and to cause heat to be directed from the refrigeration apparatus to the heating load apparatus.

In another aspect of the invention there is a recreational facility. The recreational facility includes a refrigeration plant. An ice sheet pad is connected to be cooled by the refrigeration plant. A thermal energy storage cold sink reservoir is connected to be charged by the refrigeration plant. At least one building heating load element is connected to receive heat rejected from the refrigeration plant. The refrigeration plant is operable to draw heat from either the ice sheet pad or the thermal energy cold sink reservoir as a source of heat for rejection to the building heating load element.

In another aspect of the invention there is a recreational facility. The recreational facility includes a vapour cycle refrigeration plant that uses a working fluid and includes a compressor, a condenser, an expansion device and an evaporator are all operatively connected together. There is an ice rink pad, a thermal energy cold sink storage reservoir and at least one building heating load element. There is a first heat transfer transport medium conduit assembly connected to carry a first heat transfer transport medium between the evaporator and the ice rink pad and between the evaporator and the thermal energy cold sink storage reservoir. There is a second heat transfer transport conduit assembly connected to carry a second heat transfer transport medium between the condenser and the building heating load element. The refrigeration plant is operable to draw heat selectively from either the ice rink pad or the thermal energy cold sink storage reservoir and to reject heat to the building heating load element. The working fluid is segregated from the first and second heat transfer transport media. The first and second heat transfer transport media is different from the working fluid.

In an additional feature of that aspect of he invention, the working fluid is ammonia. In another additional feature of that aspect of the invention, the first and second heat transfer transport media are at least partially glycol. In a further feature, the first and second heat transfer transport media are the same. In another feature, the first and second heat transfer transport media conduit assemblies are connected for fluid communication therebetween.

In another feature of that aspect of the invention, one of (a) the first heat transfer medium conduit assembly, (b) the second heat transfer transport medium conduit assembly and (c) the first and second heat transfer transport medium conduit assemblies are connected together, includes a flow element operable to direct flow of at least on of the heat transfer transport media between the condenser and thermal energy cold sink storage reservoir.

In another feature, the recreational facility includes fluid flow elements connected to carry heat transfer transport medium flow between the condenser and the thermal energy cold sink storage reservoir. In yet another feature, the thermal energy cold sink reservoir includes at least one container holding a thermal storage phase change material and the first heat transfer transport medium conduit assembly is connected to permit the first heat transfer transport medium to traverse the container. In still another feature, the recreational facility includes an array of containers holding a thermal storage phase change material.

In another feature, the heat transfer transport media from either of the first conduit assembly or the second conduit assembly can be directed selectively to engage in heat transfer with the storage reservoir. In still another feature, the recreational facility includes an air conditioning element in the nature of a fan coil unit connected to the cold sink storage reservoir by piping for carrying a heat transfer transport fluid, that fluid being at least partially anti-freeze.

In still another feature of that aspect of the invention, the recreational facility includes a thermal stratification reservoir for containing a portion of the second heat transfer transport medium. The thermal stratification reservoir has a low outflow port connected to an inlet of the condenser. The condenser has a high return line emptying into the thermal stratification reservoir and a plurality of building heating loads connected to draw a hot portion of the second heat transfer transport medium from the reservoir and to return the portion to the reservoir in a cooler condition. In another feature, there is a hot off take manifold connected to an upper region of the thermal stratification reservoir the feeds a plurality of building heating load elements.

In yet still another feature of that aspect of the invention, there is a heat rejection from the refrigeration plant that is used to meet at least 50% of all the building heating requirements. In another feature, there is a heat rejection from the refrigeration plant that is used to meet at least 80% of all the building heating requirements. In still another feature, there is a method of operation of the recreational facility that includes the step of operating the refrigeration plant to produce heat for rejection to be directed to the building heating load and thereby charging the cold sink reservoir as a by-product of producing heat for rejection. In another feature, there is a method of operation that includes the step of cooling the ice rink pad at one time of the day while rejecting heat to the building heating load and charging the cold sink at another time of day. In ayet further feature, there is a method of operation that includes the step of discharging the cold sink at another time of day to reduce work input to the compressor.

In another aspect of the invention there is an ice forming apparatus. The ice forming apparatus includes a compression apparatus, an expansion apparatus, a first heat exchange apparatus connectable to convey a working fluid from the compression apparatus to the expansion apparatus, and a second heat exchange apparatus connectable to convey the working fluid from the expansion apparatus to the compression apparatus. The compression apparatus is operable to receive a gas phase of the working fluid, and to compress the gas phase. The first heat exchange apparatus is operable to reject heat from the compressed working fluid to a thermal sink. The expansion apparatus is operable to permit working fluid received from the first heat exchange apparatus to undergo a pressure drop to a temperature lower than the freezing point of water. The second heat exchange apparatus is operable to transfer heat from a thermal source to working fluid received from the expansion apparatus. There is a controller. The controller is operable to govern operation of the compression apparatus. The controller is operable to cause the compression apparatus to compress the working fluid to a first pressure to yield a first temperature in the compressed gas for a first rate of heat rejection to the thermal sink. The controller is operable to cause the compression apparatus to compress the working fluid to a second pressure to yield a second temperature in the compressed gas for a second rate of heat rejection to the thermal sink. The second pressure is higher than the first pressure.

In another aspect of the invention there is a method of operating a refrigeration apparatus, the method including the step of providing a thermal storage apparatus for storing a cooled medium, thereby to provide a cold sink. The method includes the step of operating the refrigeration apparatus to produce a greater amount of rejected heat than required to obtain cooling for a cooling load, and the step of using the thermal storage apparatus as a reservoir for excess cooling potential developed while generating that greater amount of rejected heat.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF THE INVENTION

Figure 1A:
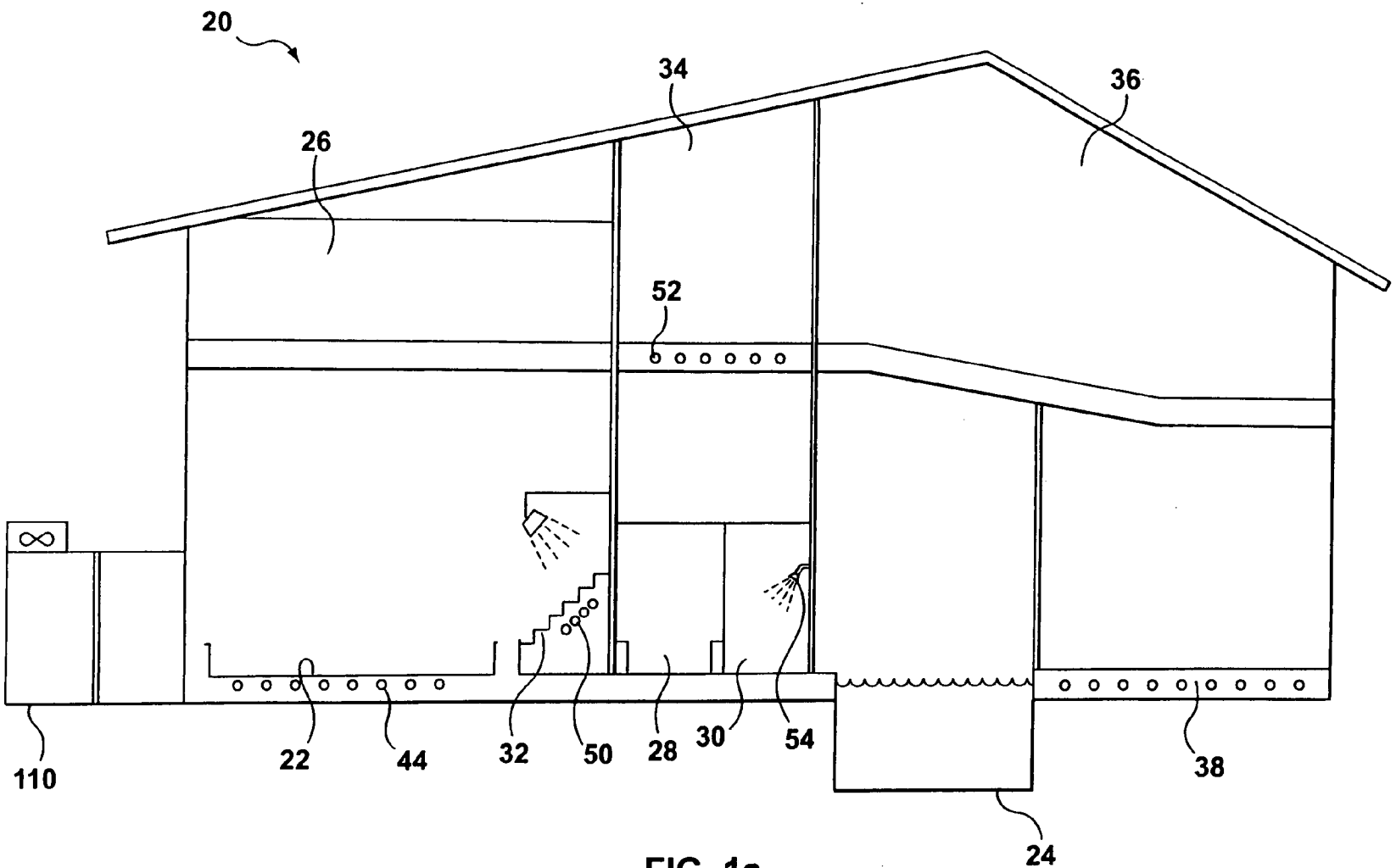
FIG. 1*a* shows a schematic representation of an example of a recreational facility embodying principles of the present invention.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

Description of a Recreational Facility

A description of the present invention may commence with the supposition of the existence of a building, such as a recreational center, indicated generally, and schematically in FIG. 1 as 20. The recreational center may be a school or a college, or part of a school or a college, a community center or other building. Recreational center 20 may include an arena, or ice rink 22, a swimming pool 24, conference rooms, or class rooms 26, dressing rooms 28, showering facilities 30, stands for spectators 32, a gymnasium 34, and an auditorium 36, an indoor soccer pitch 38, or some combination thereof. The ice rink may be a curling rink, which may have multiple sheets, or may be a pleasure skating or hockey rink with one or more ice pads. Such a building may have cooling loads (that is, a need for cooling or refrigeration) and heating loads (that is, a need for heating) that may vary with the time of day, the season of the year, the activities occurring in the building, and the amount of sunshine per day. There may be simultaneous heating and cooling loads, as when there is a cooling load to make ice in the ice rink, and a heating load to keep the gymnasium or auditorium warm. A space that requires heating at one time of day may require cooling at another time of day. For example, when the auditorium is used as a fractionally filled lecture hall it may require heating, but, later, when it is used as an entertainment hall for a sold out public performance, it may require cooling.

Figure 3A:
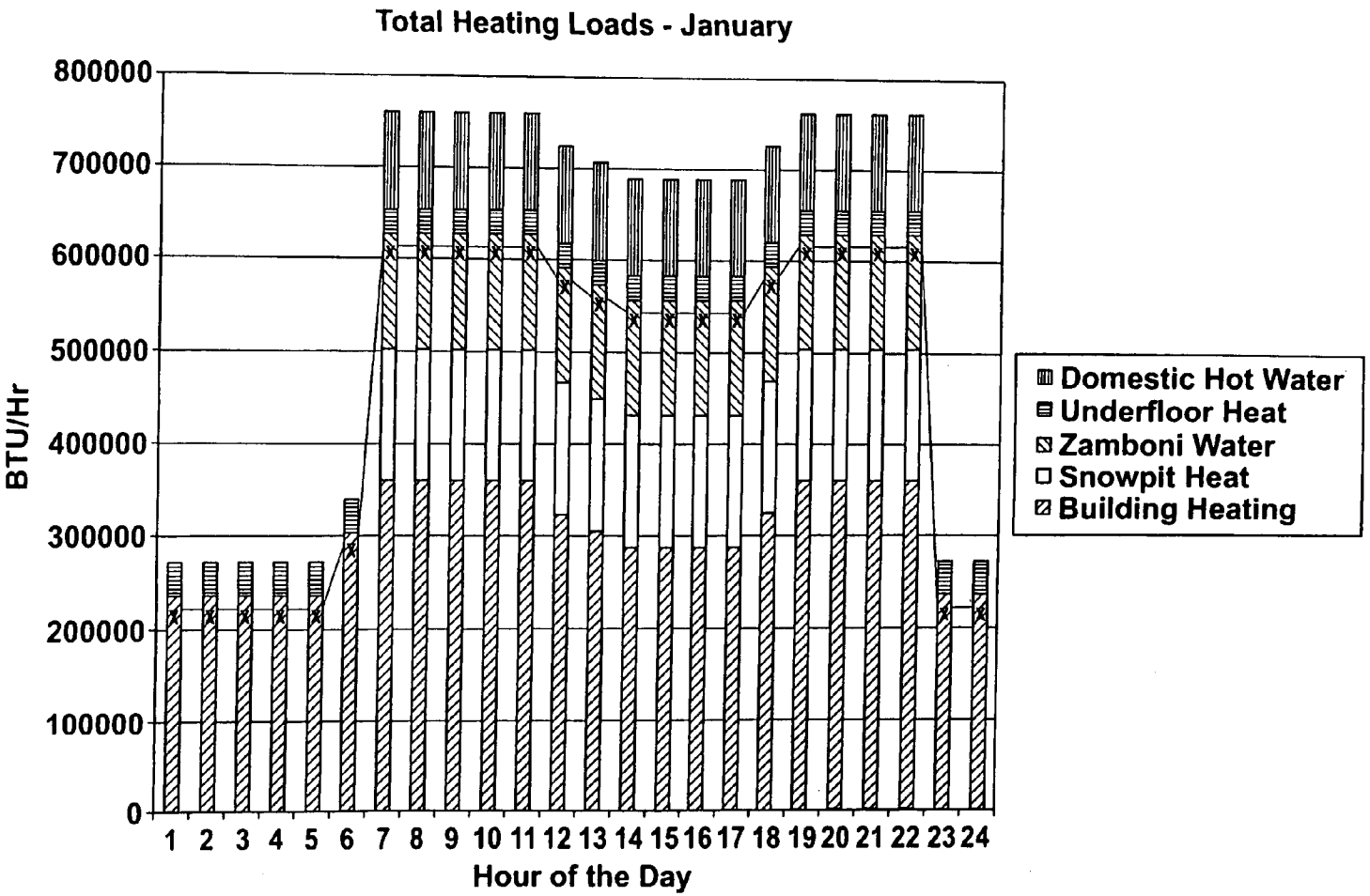
FIG. 3*a* shows a heating load v. time chart for the recreational facility of FIG. 1*a* in January.

In general, there will be time varying-cooling and heating load profiles for recreational center 20. The cooling load may tend to be lowest at night, and higher during the day, particularly when the Sun is shining on the building. During the night the rink may be on "night set-back", since the rink is not in use, and needs only to be maintained in its condition, rather than being capable of making new ice. The heat loads in the arena may be less at night as well, given the generally cooler external ambient at night, the absence of a light load (assuming the lights are turned off at night), and the lack of a human load when the building may tend to be unoccupied. FIG. 3*a* shows the heating load in a colder period of the year, such as January in the Northern hemisphere. It is assumed that ice rink 22 may be maintained in operation year round. This, of course, is not necessarily true at all ice rink locations. Some locations operate as ice rinks in the Winter months (typically from September 1 to April 30 in southern Canada, for example), and as rinks for roller skating or in-line roller blading in the Summer months.

The building, namely recreational center 20, may be equipped with an energy management system, indicated generally as 40, for responding to these environmental loading conditions. Energy management system 40 may include a refrigeration plant or apparatus, such as may be in the nature of an ice making apparatus 42 connected to cold floor piping 44 embedded in a concrete pad defining a floor of ice rink 22; a cold sink thermal storage member, or apparatus, indicated as an "ice reservoir" 46; a first underfloor radiant heating system 50 for use in the arena stands, a second underfloor radiant heating system 52 for use in the gymnasium, a hot water supply 54, such as may be used to provide domestic hot water or Zamboni (t.m.) water; a snow pit heater 56; a building fan coil heating or air conditioning system 58, a building radiant heat zone apparatus 60, a building heat pump 62, and a supplemental heating device 64, such as may be an oil or gas fired boiler 66. A "Zamboni" is a brand of ice refinishing truck that is used to renew the ice surface every hour or two during normal hours of operation (e.g., roughly 6 a.m. to midnight).

Refrigeration Apparatus

Refrigeration apparatus 42 may be a vapour cycle system in which a working fluid is passed, in succession, through a pressurizing stage 68, as when run through a pump, or compressor 70; a cooling stage 72, as when passed through a first heat exchange device 74, such as condenser 76; an expansion stage 78, such as when passed through an expansion apparatus 80, such as may be a valve, or nozzle, 82; and a heating stage 84, such as when passed through a second heat exchange device 86, such as may be identified as a chiller, or evaporator 88.

The Compressor

Compressor 70 may be a reciprocating compressor, may be a rotating vane compressor, or a screw compressor. The compressor may be a gas compressor that may be used to compress a working fluid in a gaseous state to a higher temperature and pressure. Compressor 70 may symbolise not merely a single compressor, but an array of two or more compressor units, such as units, 90, 92, arranged in parallel to permit partial operation at times of reduced demand.

The Condensor

Working fluid may be carried from the outlet of compressor 70 to the inlet of the condensor in a fluid conducting element 94, such as a piping for carrying high pressure gas. Condensor 76 may typically be a heat exchanger of either the tube and shell type or the multiple alternating plate type with either a dual or multiple plate arrangement, and may be either a cross flow heat exchanger, or a counter flow heat exchanger. It may be advantageous to employ a counter-flow multiple plate capillary tube heat exchanger to obtain relatively high performance. Heat exchanger 74 has a first fluid path for the refrigerant working fluid, that path having an inlet 96, and an outlet 98, inlet 96 being connected to receive hot, high pressure working fluid from compressor 70, and outlet 98 being connected to permit cooled, high pressure working fluid to be conducted to expansion apparatus 80. Heat exchanger 74 also has a second fluid flow path, the second fluid flow path being segregated from the first fluid flow path. The nature of the heat exchange in condensor 76 is such that the first fluid flow path is the hot side of the condensor from which heat is being extracted, and the second fluid flow path is the cold side of the condenser through which coolant flows, thereby carrying heat away. A coolant for the cold side of condensor 76 may be chosen from any of a number of cooling media, of which, in one embodiment, the coolant may be glycol (t.m.). In a vapour cycle system, such as may be employed, the state of the working fluid may tend to be transformed in condensor 76 from a superheated gas to a liquid, or to a mixed phase fluid of partial gas, partial liquid quality.

The Expansion Device

Cooled, relatively high pressure working fluid may be conducted in a fluid flow conduit 100, such as may be a high pressure seamless steel pipe, to expansion apparatus 80. Expansion apparatus 80 may tend to be a substantially adiabatic device in which the pressure of the fluid is reduced, with a corresponding drop in temperature, and enthalpy. Expansion apparatus 80 may, in some instances, be a work extraction device, in the nature of a turbomachine, or may be a nozzle, orifice, or valve, of suitable geometry, such as nozzle 82. In a typical vapour cycle device, the working fluid enters the expansion device as a liquid, or largely liquid flow.

The Evaporator

Evaporator 88 may include second heat exchange device 86, connected to expansion apparatus 80 by a low side pressure fluid conduit, or pipe 102. Fluid carried by pipe 102 enters evaporator 88 at inlet 104, and follows a first flow path through the evaporator to an outlet 106. Evaporator 88 also has a second flow path, segregated from the first flow path. The first and second flow paths of evaporator 88 are segregated from each other and may be in a cross-flow, or counter flow arrangement. As above, evaporator 88 may have the physical form of a tube-and-shell heat exchanger, or may have the form of a heat exchanger having multiple, substantially parallel plates or layers. These layers may be tightly packed to give a low temperature difference across the heat exchange interface between the coolant and the working fluid. By the nature of the device, the hot side of the heat exchanger is the second flow path, which may contain a relatively inert and relatively benign heat exchange fluid that may tend to be in the liquid phase, and that has a freezing point below the range of operation of the machine. This coolant medium may be a fluid such as glycol (t.m.). This heat exchange fluid may flow in a circuit of piping connected with one or more of the cooling load devices noted below. The cold side of this heat exchanger (i.e., evaporator 88) carries the working fluid. Most typically, working fluid entering evaporator 88 may be of intermediate quality in a mixed liquid and vapour state under the pressure done as indicated in the Pressure v Enthalpy chart of FIG. 2. Heat added in evaporator 88 converts the working fluid to gas. It is often desirable for the working fluid leaving evaporator 88 to be somewhat superheated beyond the saturated gas line, thereby tending to avoid ingestion of liquid working fluid into compressor 70. For the purposes of analysis, a designer may wish to consider four thermodynamic state points for the working fluid, those points being (1) at the inlet to compressor 70; (2) at the outlet of the compressor 70; (3) at the outlet of the condensor 76; and (4) at the inlet to evaporator 88. Also for the purposes of simple or approximate analysis, although there is fluid flow resistance in both heat exchange elements, they are idealised as being constant pressure devices.

Working Fluid

In this example, in the event that a vapour cycle system is used, as opposed to a gas cycle or other system, the vapour cycle system may employ a working fluid, as noted above. That working fluid may be any of a number of possible working fluids, be it an HCFC working fluid or some other. In one embodiment the working fluid may be refrigerant R-404A. In another embodiment the working fluid may be ammonia, also designated as refrigerant R-717.

Ammonia may be chosen as a working fluid for a number of reasons. It is readily available; it is relatively inexpensive; it dissipates relatively quickly and easily in air, it does not tend to cause lasting environmental damage in terms of either ozone depletion or green house gas omissions if it leaks, and does not tend to present a long lasting toxicity problem when disposal is desired; and, in ice making technology, there is a well established level of knowledge and expertise in the industry in using ammonia. Further, the working range of pressures and temperatures for ammonia may tend to be suitable for the present purposes. Ammonia may tend to permit the use of relatively common mineral oil lubricants, as opposed to highly specialized (and expensive) hygroscopic oils. Ammonia may tend to permit smaller pipe sizes, better heat transfer and smaller heat exchangers. Leaks may tend to be relatively easy to detect. Ammonia tends to be relatively tolerant of moisture in the system.

Heat Transfer Transport Medium

Figure 1B:
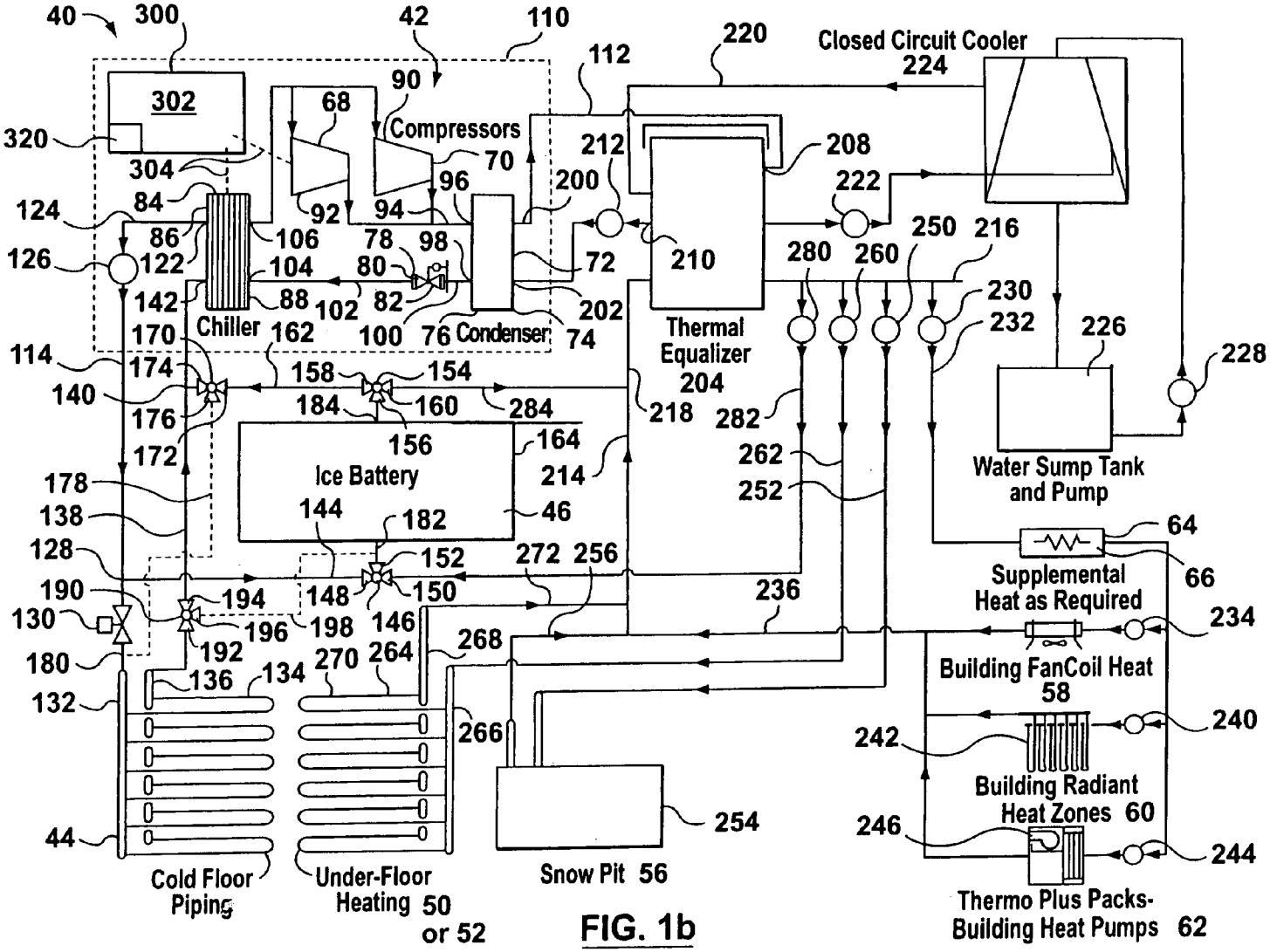
FIG. 1*b* is a second schematic representation of the recreational facility of FIG. 1*a* showing the relationship of heating load, cooling load, and heat transfer apparatus for addressing the heating and cooling loads.

Refrigerating apparatus 42 may be contained in a separate building, or segregated structure 110, as, symbolised by the dashed line rectangle in FIG. 1*b*. This construction permits all devices through which the working fluid passes (which may be referred to as the refrigeration plant) to be segregated from, and to be separately ventilated from, the enclosed building structure of facility 20 in which persons may be engaged in recreational activities. In this way, a leak of the working fluid may tend not to migrate into occupied areas of recreational facility 20, and may tend to be vented to external ambient. In keeping with this, heat transfer transport medium conduit assemblies, namely the heating and cooling circuits emanating from segregated structure 110, such as low pressure coolant circuit 112 that carries coolant to and from the cold side of condenser 76, and low pressure coolant circuit 114 that carries coolant to and from the hot side of the chiller, i.e., evaporator 88, may tend to be relatively low pressure, liquid conduits operating at modest positive pressure over ambient, carrying a more-or-less non-corrosive liquid heat transfer medium in the nature of a liquid coolant of relatively low toxicity, and low volatility, and such as may tend not to pose an undue environmental hazard if a leak should occur, such an antifreeze or antifreeze mixture of which one type may be glycol. A fluid of this nature may tend to be significantly less corrosive than Ammonia or a brine solution. Further, when used in the context of this application the term "glycol" may refer to a mixture of glycol and water such as may be suitable for the operating range of the equipment, be it −30 C. to +60 C., −40 C. to +70 C. or some other range.

Cooling or Refrigeration Load and Storage Elements

Cold Floor Piping

Whether for heating or cooling loads, the piping, or assembly of conduits for carrying the heat transfer fluid transport medium, may tend to be laid out in a manner defining a circuit, or a plurality of circuits, through which coolant may be pumped to and from the refrigeration plant and the various Heating and cooling load elements.

Referring to the schematic of FIGS. 1*a* and 1*b*, the primary cooling load for an ice making apparatus in an arena is, generally speaking, the refrigeration load of the ice rink pad or pads. To that end, ice rink 22 has underfloor cold ice piping 42, as noted. In the embodiment of FIG. 2*a*, coolant circuit 114 is connected to the hot side outlet 122 of the chiller (i.e., evaporator 88) by a first fluid conduit portion in the nature of a pipe section 124 leading to a cooling loop pump 126 that may be used to urge coolant through a tee 128, and through a first valve 130 and into cold floor piping 44. Cold floor piping 44 may include a header identified as rink inlet manifold 132. An array of underfloor loops 134 are fed from the common pressure source of rink inlet manifold 132, loops 134 returning to, terminating at, and discharging into, a second header, identified as rink return manifold 136. Return line 138 carries the coolant back through a tee 140 to the inlet 142 of the hot side of the chiller. It is understood that in passing through loops 134, the coolant will tend to draw heat from the ice rink pad, or pads, as the case may be, and, to the extent that the pad is maintained at a temperature below the freezing point of water, and to the extent that sufficient water is maintained above the pad, a sheet of ice will be maintained in a frozen state, or new ice may be made as a surface accretion of water is frozen. Thus heat may flow from the arena surroundings into the pad of ice, from the pad of ice into the coolant loops, and from the coolant into the evaporator.

Although only one array of loops is indicated in the schematic, this may be representative of two or more pads, each having an array of cooling loops, and which may be fed sequentially between inlet and outlet manifolds such as may be controlled by selectively operating a number of valves according to a refrigerating duty cycle, or simultaneously, as may be desired.

Cold Sink Thermal Storage Reservoir

As noted above, the coolant circuit may include a first tee 128 upstream of the ice pad, and a second tee 140 downstream of the ice pad. First tee 128 may be used to feed coolant fluid through an alternate fluid communication path, namely ice reservoir feeder pipe 144, to a second valve, identified as ice reservoir inlet valve 146. While valve 146 may have two inlets, 148 and 150, as indicated, it has but a single outlet 152 leading to ice reservoir 46. Valve 146 may have three positions—namely, inlet 148 open, and inlet 150 closed; or inlet 148 closed and inlet 150 open, or both inlet 148 and inlet 150 closed. Similarly, the outlet of ice reservoir 46 feeds a third valve, identified as ice reservoir outlet valve 154. Outlet valve 154 has an inlet 156, and a pair of alternately selectable outlets, 158, 160. This valve may have three positions as well, namely outlet 158 open and outlet 160 closed; outlet 158 closed and outlet 160 open; or both outlet 158 and outlet 160 closed. Outlet 158 is connected to a cooling side return line 162 which, in turn, meets coolant return line 138 at tee 140. Differential operation of valves 130, 146 and 154 may then permit the coolant medium on the hot side of the chiller to be directed to the floor loops 134 of the ice pad, or pads (as when valve 130 is open, and valve inlet 148 is closed), or to ice reservoir 46 (as when valve 130 is closed and valve inlet 148 and valve outlet 158 are open, and inlet 150 and outlet 160 are closed).

Given the operation described, the positions of valves 130, 146 and 154 may be interlinked mechanically or electronically. In particular, the positions of valves 146 and 154 may be governed such that both are open at the same time to flow of coolant in the cooling circuit and closed to coolant flow from the heating circuit; or, conversely, both are open to the heating load side of the system, but closed to the cooling circuit. The positions may also be governed in such a manner that when inlet 148 and outlet 158 are open, inlet 150 and 160 are prevented from opening, and vice versa. It may also be noted that coolant pump 126 may have a pressure relief bypass in the event that both valve 130 and valve 146 are closed simultaneously, as they may be during a change of duty cycle.

Figure 3B:
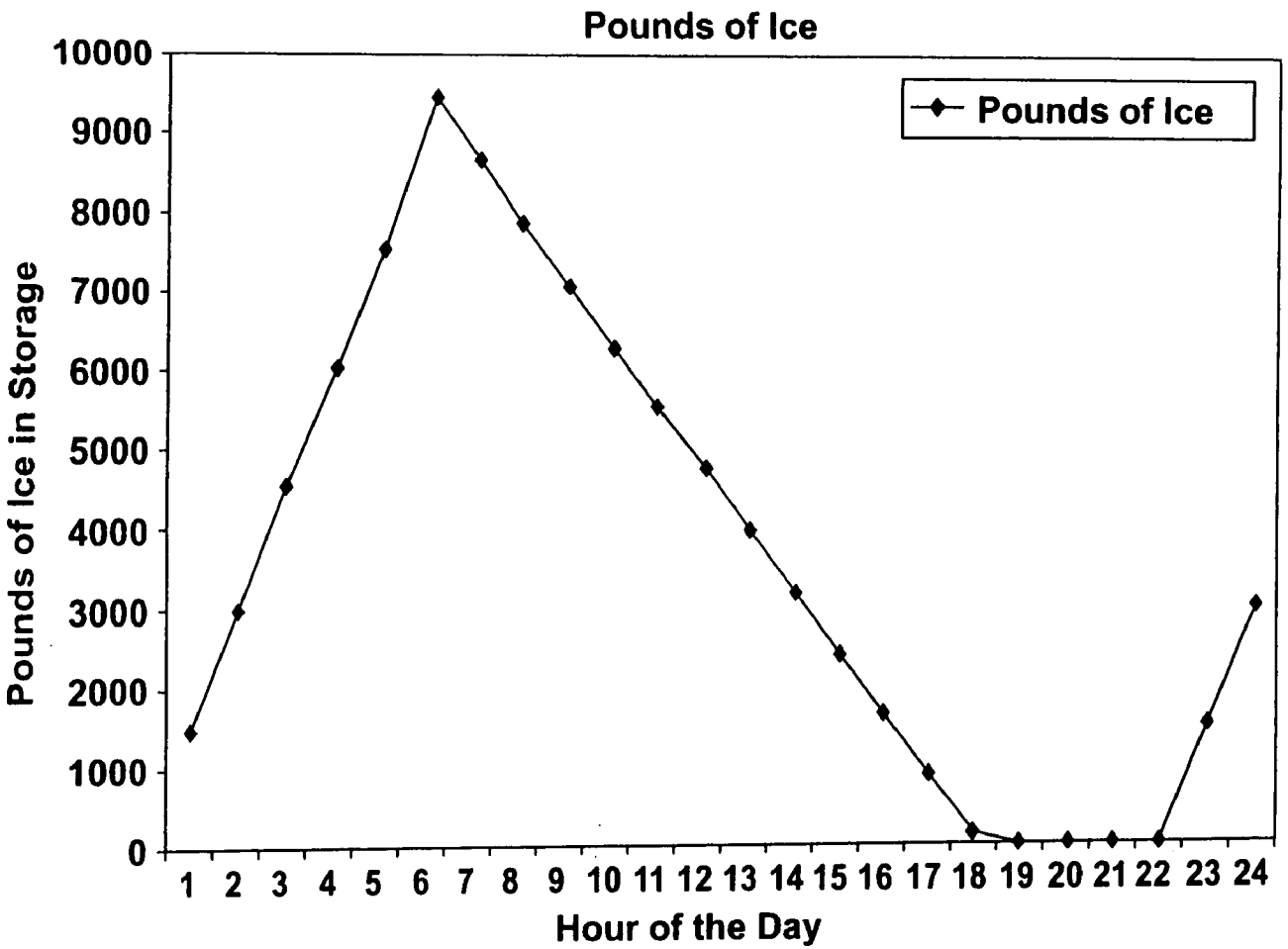
FIG. 3*b* shows a thermal storage cold sink charge and discharge chart for the recreational facility of FIG. 1*a* in January.

The cold sink thermal storage member, or thermal capacitance member may, for brevity and simplicity be referred to as an "ice reservoir", 46. It may be that ice reservoir 46 is an accumulation of ice, typically enclosed in an insulated wall structure, identified as 164. It may also be that ice reservoir 46 is not "ice" at all, but rather a brine, or an eutectic fluid, or some other medium such as may tend to have a significant thermal mass, such that ice reservoir 46 may tend to work as a thermal capacitance that can be "charged up" by being cooled over a period of time, so that it may then have a large capacity to cool other objects at a later time. This is illustrated in FIG. 3*b*. It may be that ice reservoir 46 employs a phase change material, such as a eutectic fluid as noted above, where there is a significant enthalpy drop between the warm state, possibly a liquid or quasi-liquid state, and the cool, or cold state, possibly a solid or quasi-solid state. A liquid freezing point would, for example, tend to be just such a large enthalpy, narrow temperature range phenomenon. Where an eutectic material is used, it may be an eutectic having a phase change temperature lying in the range of −40 to +20 F., or possibly in the narrower range of −20 F. to +0 F. The phase change medium may be water, or an aqueous solution.

The arrangement described thus far may tend to permit coolant to flow selectively to either ice reservoir 46 or cold floor piping 44, or to both in parallel if valve 130 is maintained in an intermediate or partially open condition. However, as described to this point the two loads have not been placed in series with each other. In an alternate embodiment, a further valve 170 may be located in line 162 between valve 154 and tee 140, this valve 170 having an inlet 172 fed by line 162 from valve 158. Valve 170 may also have a first alternately selectable outlet 174 by which to direct flow through to tee 140, and hence to the return, and a second, alternately selectable outlet 176 by which to direct flow of coolant from ice reservoir 46 through alternate feedline 178 to a tee 180 connected between valve 130 and inlet manifold 132 to permit feed inlet manifold 132 of the underfloor cooling loops 134 of the ice pad. In operation, if valve 130 is closed, inlet 148 of valve 146 is open, outlet 158 of valve 154 is open, outlet 174 is closed, and outlet 176 is open, coolant driven by pump 126 will be forced through ice reservoir 46, and then in series into cold floor piping 44.

In yet a further alternative, a valve 190 may be teed into the coolant return line 138 outlet line running from outlet manifold 136 of the array of underfloor cooling loops toward the chiller. Valve 190 may have an inlet 192 oriented toward the ice pad outlet manifold 136, a first outlet 194 oriented toward the chiller, and a second outlet 196 oriented toward a shunt line 198 that meets the inlet line of ice reservoir 46. By closing inlet 148 of valve 146 (inlet 150 also being assumed closed), opening valve 130, opening outlet 158 of valve 154 (and closing outlet 160), and opening outlet 196 while closing outlet 194, coolant driven by pump 126 can be directed through the cold floor piping 44 of the ice pad in series with ice reservoir 46, but with the coolant being directed to ice reservoir 46 after leaving the ice pad cooling array, rather than before.

Ice reservoir 46 may be a large insulated enclosure 164, or box or fluid tight chamber through which liquid coolant, such as glycol, can be pumped. The enclosure may contain a large number of hollow balls 166 such as may be made of a plastic material. Balls 166 may contain a phase change thermal storage medium, which may be distilled water, or some mixture or other substance such as may have, for example, a large enthalpy change at a state change plateau temperature, or relatively small range of temperature, in the desired operating temperature range as noted above. Balls 166 may be stacked to permit interstitial flow of the liquid coolant. Balls 166 segregate the heat transfer storage medium phase change material from the heat transfer transport medium. Ice reservoir 46 has an inlet 182, and an outlet 184, such that coolant fed in at inlet 182 may tend to work its way through any of a large number of possible flow paths by wending about the collection, or stacked array, of balls 166 to outlet 184, this process being accompanied by heat transfer between the diffusely moving liquid and the thermal storage medium containing balls 166. Where the liquid heat transfer medium is warmer than the material in the balls, the liquid may tend to be cooled, and where the liquid is cooler than the material in the balls, the liquid may tend to be warmed.

Hot Side Elements

Thermal Equalizer

Thermal equalizer 204 is a large heat exchange fluid heat transfer medium stratification reservoir, or tank. The cold side loop 112 drawing hot coolant from outlet 200 of condensor 76 is carried to hot side inlet 208 near the top of thermal equalizer 204, and may be drawn out at the relatively lower temperature outlet 210 located near the bottom of thermal equalizer 204, through pump 212, and back to inlet 202 of evaporator 88. Cold side loop 112 carries a relatively benign coolant, such as glycol (or, as noted, a glycol-water mixture), out of segregated structure 110 that contains refrigeration apparatus 42.

Thermal equalizer 204 may be served by a multi-path conduit assembly identified as coolant circuit 214, having a hot, or upper outlet manifold 216 whence to draw off warmed coolant, and a return, or cooled, lower inlet manifold 218 at which to introduce returning coolant. Thermal equalizer 204 includes a third path, through which coolant may be passed on a closed circuit cooler loop 220, driven by coolant pump 222. At times when there is no thermal load, or insufficient thermal loading, to accept all of the heat rejected from refrigeration apparatus 42, the excess heat rejected from condenser 76 may be dumped into coolant carried in coolant circuit 214, whence it is rejected into water such as may be sprayed over cooling pipes in closed circuit cooler 224. The water thus warmed may drain into a water sump 226, from which it is drawn by pump 228 and conducted again back into closed circuit cooler 224.

Thermal equalizer 204 is a reservoir in which the coolant medium may settle and stratify according to temperature. Thus hot return flow from condenser 76 is added to the top of thermal equalizer 204, and cooled coolant directed to the inlet of condenser 76 is drawn from the bottom of thermal equalizer 204. Similarly, hot fluid for direction to the various heating loads is drawn from the upper region of equalizer 204, and returned to the bottom.

Supplemental Heat

On occasions where there may not be sufficient rejected heat available from condensor 76 to meet all of the heating loads of recreational facility 20, or where the temperature of the heat rejected is not fully sufficient to meet the temperature requirements of, for example, a radiant or fan coil heater or a hot water heater, that unmet demand may be met by the employment of a supplemental heating device, such as oil or gas fired boiler 66. Further, a supplemental heating device may be employed in the event that refrigeration apparatus 42 is not in service, and an alternate heat source is required. To that end, pump 230 may urge coolant from thermal equalizer outlet manifold 216 along line 232 to boiler 66. In the event that extra heating is not required, the coolant may pass through the supplemental heating device, or through a bypass, without the heating element being in operation. After leaving the supplemental heating device, the coolant, having had a temperature boost (or not, as may be appropriate in the circumstances), may be directed to pump 234. Pump 234 may be used to urge the warmed coolant through the building fan coil forced air heating system, such as may be used in the classrooms, the auditorium, the dressings rooms, and so on. At some times of year this system may be used to provide heating, and at other times of year to provide cooling (e.g. to act as an air conditioner), such as when coolant from ice reservoir A6 is directed through cooling circuit 238 and building fan coil 58 and returned via the shunt valve between return line 236 and line 282. When used for heating, coolant exiting the fan coil heating system is carried along return line 236 to inlet manifold 218.

Alternatively, or additionally, warm coolant leaving the supplemental heating device may be directed to pump 240. Pump 240 is operable to urge coolant through building radiant zone heating apparatus 242. Apparatus 242 may, again, be installed in classrooms, in dressing rooms, in hallways, in the auditorium, and so on. Coolant exiting this system returns through line 236 to inlet manifold 218.

In a further alternative, warm coolant leaving the supplemental heating device may be directed to pump 244. Pump 244 is operable to urge coolant through heat pump 246, such as may be operable to provide local heating or cooling within recreational center 22. As before, return coolant is directed into return line 236 and carried to inlet manifold 218.

In another heating load circuit, pump 250 draws warmed coolant from outlet manifold 216 and urges it along fluid conduit 252 to provide heating to the multi-loop heating element 254 to melt snow in the snow pit 56 in the Zamboni room. The return line 256 from snow pit 56 carries coolant back to inlet manifold 216. In yet another heat load circuit, pump 260 may draw warmed coolant from outlet manifold 216 and urges it along fluid conduit 262 to underfloor heating array 264, which may include an inlet manifold, or header, 266, an outlet manifold, or header 268, and several underfloor heating loops 270 such as may be used to provide radiant floor heating in a gymnasium, on a pool deck, under a walkway, or in one of the other rooms or enclosed spaced of recreational facility 20. Coolant then flows from outlet manifold 268 through return line 272 to inlet manifold 218. In still another heating load circuit, hot coolant from thermal equalizer 204 is driven by pump 280 from outlet manifold 216, through fluid conduit 282 to the hot side of valve 146, through which it may be directed through ice reservoir 46, valve 154, and return line 284 back to inlet manifold 218. This may occur when valves 146 and 154 are "open" to the heating load fluid, and closed to the cooling load fluid. In this instance, the cold storage capacity of ice reservoir 46 is employed as a heat rejection sink for heat extracted from condensor 76. This, in turn, may tend to reduce the inlet temperature on the cold side of the condensor, and allow the system to operate at a lower heat rejection temperature. To the extent that the charging cycle of the ice reservoir is premised on the existence of time periods in which the heat load exceeds that amount of rejected that that would otherwise normally be available from the refrigeration plant maintaining the ice sheets, the portion of the cycle in which the ice (or solid phase of the storage medium) in ice reservoir 46 may melt may tend to be coincident with (a) a reduced heating load or (b) a differential shift to a greater ice pad cooling load. Alternatively, the ice (or solid phase) may be melted by operating the system to provide, for example, air conditioning through circuit 238 as noted above.

In the foregoing example, the heat transfer transport medium, namely the liquid coolant, from the hot side of the system (i.e., the side with the heating loads) may be directed through ice reservoir 46 to draw out the stored cooling, in the same manner as the heat transfer medium on the cold side of the system (i.e. the side with the refrigeration loads) had previously been directed through ice reservoir 46 to charge up the thermal storage medium by freezing (i.e., changing the phase from liquid to solid) the thermal storage medium inside balls 166. This may be facilitated by using the same heat transfer transport medium in both the hot and cold sides of the system, and may permit fluid from the hot side and from the cold side of the system to be passed alternately across the thermal storage medium array. Further, the use of a relatively non-corrosive liquid, such as glycol or a glycol mixture, may tend to permit the same fluid to be used in conventional building heat exchangers of either the forced air or radiant types, thus tending to facilitate the integration of the ice making refrigeration source as a heat pump for satisfying other building loads, as formerly addressed by conventional building mechanical systems for heating and air conditioning.

Electronic Control

Operation of energy management system 20 is governed by an electronic control system, 300, that includes a controller 302, and an array of sensors 304 such as may include (a) temperature sensors; (b) pressure sensors; (c) humidity sensors; (d) volumetric flow rate sensors; (e) thermostat settings; (f) external ambient condition sensors (g) solar sensors; and (h) a clock, or clocks. The use of temperature and pressure sensors in refrigeration apparatus 42 permits the operating statepoints to be known, and adjusted, according to existing heating and cooling demands, and according to anticipated demand such as may be determined from historic demand parameters stored in memory, and on the basis of external weather conditions.

Electronic control system 300 may include a memory 320 having climatic data for the site of installation, including sun rise and sunset times for the location, and it may have stored ambient temperature and pressure information from recent days for use in extrapolating thermal load management estimates. It may include setting temperatures for the various heat sinks and heat sources. The memory data may include data for working fluid pressure, temperature, enthalpy, entropy, and density, from which other, intermediate statepoint conditions may be interpolated. Electronic control system 300 may also include programmed steps for calculating the statepoints at which refrigeration apparatus 42 might best operate for given loading conditions, or expected loading conditions based on time of day, weather, and historic demand.

EXAMPLES

Figure 2:
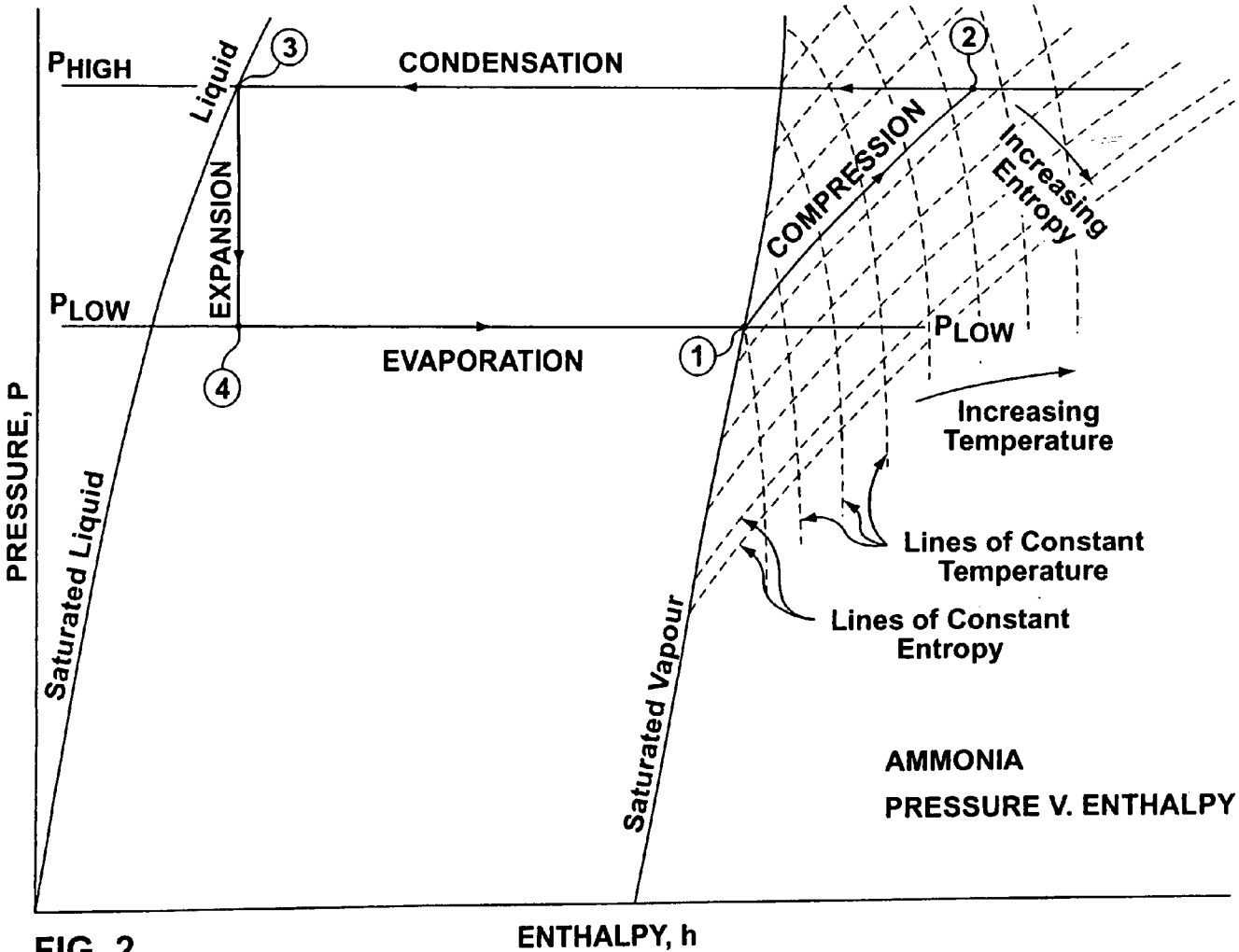
FIG. 2 shows a Pressure v. Enthalpy chart for a refrigerating apparatus for the recreational facility of FIG. 1*a;*

In one embodiment, a vapour cycle system such as may be employed in refrigeration apparatus 42 may use Ammonia as a working fluid. The low side of the vapour system may operate at a low pressure, $P_{LOW}$ of between 30 and 40 psia, and may, in one example, operate at about 38 psia, with a temperature under the vapour dome of between 0 F. and 20 F., and possibly about 10 F. when $P_{LOW}$ is 38 psia at the first statepoint at the exit from evaporator 88. There may be a few degrees of superheat at evaporator 88 to discourage the ingestion of liquid working fluid in compressor 76, or compressors 76, as may be. Referring to FIG. 2, compression may occur along a roughly isentropic path from the first statepoint at the inlet to compressor 70 to the second statepoint at the inlet to condensor 88 (the increase in entropy being relatively small), and may be roughly adiabatic, with relatively little opportunity for either heat loss or heat gain in the compressor itself. The high side of the system, at the second state point, may operate at between 160 psia and 200 psia, and may be about 181 psia, during daytime operation (that is, between about 8 a.m. and 8 p.m.). The temperature at the second statepoint may be in the range of 200–260 F., depending on the pressures. The hot side condensing temperature at the third statepoint (at the outlet of condenser 88) may be in the range of about 80 F. to 120 F., and may, when $P_{high}$ is about 181 psia be about 95 F. The outlet of the condenser may operate at a statepoint lying at or very near to the saturated liquid line of the vapour dome. Expansion through the expansion device, which may be a valve, from the third statepoint to the fourth statepoint at the inlet to the evaporator 76 may be considered to be adiabatic. The co-efficient of performance of this system operating between these pressures, and with an expansion device inlet condition at $P_{high}$ and saturated liquid, may be about 4.2 to 4.3.

During night-time operation this system may operate at about the same conditions on the low side, but at a reduced temperature and pressure on the high side. That is, during the night, the cooling load on the ice pad may be much lower, so the system may run at a reduced output. During this time there may be excess refrigeration capacity, well in excess of the cooling required to maintain the sheet, or sheets, of ice in the arena. In some instances, the environmental control system for recreational facility 20 may operate very well under these conditions.

In that light, the system may operate with a reduced pressure differential during night time operation, such that the statepoints may be approximately as follows: The first statepoint, at the inlet to the compressor, may be at a pressure of between 30 and 40 psia, and may, specifically, operate at about 38 psia. The outlet temperature may be about 10 F., and the condition of the working fluid may be at the saturated gas line, or may be warmer by a few degrees of superheat to discourage ingestion of liquid working fluid in the compressor.

The working fluid is compressed from the first state point to the second statepoint in a nearly isentropic, substantially adiabatic compression. The second statepoint, at the inlet of the condensor may be at a pressure of between 120 and 140 psia, with a temperature of between about 65 and 80 F., and may be at about 126 psia at about 70 F.

The third statepoint, at the outlet of the compressor or inlet of the expansion device, may be at the saturated liquid line, at the high pressure, which, as noted, may be in the range of 120 to 140 psia, and may be about 126 psia.

The fourth statepoint is reached by adiabatic expansion through the expansion device, such as may be a valve, from the third statepoint to the low side pressure of the first statepoint.

For this example, the co-efficient of performance may be between 7.0 and 8.0 and may be about 7.26.

During night time operation the cooling capacity of refrigeration apparatus 42 may be used alternately to maintain the ice surfaces and to charge ice reservoir 46 by adjusting the positions of the various valves in the coolant load circuits.

During daytime operation, heat rejected from the condensor, and carried through thermal equalizer 204, may be used to heat ice reservoir 46, with the effect that the heat rejection temperature seen at the condensor may be somewhat reduced. This may permit the system to be operated at a somewhat more efficient operating point than might otherwise be the case during the time it may take to "discharge" ice reservoir 46. At another time, such as at night, the process may again be altered to re-charge ice reservoir 46, and so on.

However, it may be that the heat rejected by refrigeration system 42 while this substantially reduced night time load is being addressed may not be fully sufficient to address other heating loads in recreational facility 20. That is, it may be desired to have greater heat rejection, at higher temperatures. In that instance, refrigeration system 42 may be operated at a greater percentage of its overall capacity to provide a greater amount of rejected heat, at a higher heat rejection temperature. In so doing refrigeration apparatus 42 may provide cooling to charge up ice reservoir 46 (that is, to extract heat from ice reservoir 46, thereby tending to cause a significant enthalpy reduction in the thermal storage medium such as may tend to cause a phase change, such as freezing, of the thermal storage medium). It is assumed that, in general, in a mid-latitude location, during much of the hockey season that for much or all of the day the external environmental conditions may include an ambient temperature greater than the freezing point of water, namely 32 F., (or, really, greater than about 20–25 F., since it may be better to have a sheet of ice for hockey, skating, or curling, whose temperature is modestly, yet clearly, below the freezing temperature) such that refrigeration is required to maintain the ice rink surface, or surfaces, at an appropriate temperature for hockey, pleasure skating or curling. It need not necessarily be so, since refrigeration apparatus 42 may be used as a heat pump to reject heat into recreational facility 20 even when the external ambient temperature is significantly lower than 20 F.

In those circumstances, rather than being operated at a full set back condition, refrigeration apparatus may be operated to reject a greater amount of heat, and thereby to produce a greater amount of cooling than might otherwise be required merely to maintain the ice sheets in their desired frozen condition. That being the case, operation may include the step of re-directing coolant flow leaving the chiller (i.e. evaporator 88) hot side through ice reservoir 46, rather than (or in addition to, or in alternating duty cycle with) cold floor piping 44, thereby "charging" ice reservoir 46. Operation may then include operating at a floating head pressure (i.e., the pressure at the compressor outlet) to yield a desired outlet temperature at outlet 200 of circuit 112 (or at inlet 208 of thermal equalizer 204) thereby yielding heat to be directed to any of the heating load elements described above as may be appropriate in the circumstances. Thus, for example, rather than having a compressor outlet temperature of 70° F., the outlet pressure may be about 130–150° F. t yield useful heat for zone heating or water heating. The corresponding high side pressure might be in the range of approximately 80–120 psia, or, less modestly, it might be run at 160–200 psia, as may occur during customary daytime operation, e.g. 181 psia @ about 220° F. A "floating" head pressure may be obtained by providing a compressor that is variably operable to yield varying output pressures. It may be noted that electricity may be less expensive at night than during daytime hours such that the cost of extra operation of the compressors at night may not be unduly high.

In a first example of an alternate embodiment, the low side of the vapour cycle system may operate at a colder temperature, being in the range of −5 to −30 F., and perhaps about −15 to −25 F. In such an embodiment, ice reservoir 46 may contain a eutectic material having a melting point in the range of −20 to 15 F., that is, the phase change from solid to liquid of the "ice reservoir" thermal storage medium may take place under the vapour dome at a temperature level, on the phase change plateau, that is less than the freezing point temperature of the fluid, namely water, from which the hockey ice is to be made, and, indeed, at a temperature that is less than the desired use temperature for the ice surface. To the extent that the desired ice surface temperature for skating may be in the range of 20–25 F., the thermal storage medium may have a eutectic phase change temperature may be in the range of −25 to about 10 to 15 F.

In the event that ice reservoir 46 is connected in series with the cooling loops 134 of the ice pad array, the enthalpy of the phase change in ice reservoir 46 may be used to provide a measure of extra cooling of the coolant fluid being admitted to the underfloor coolant loops (which may, in turn affect, in some measure, statepoint 4), as when ice reservoir 46 is upstream of the underfloor cooling loops of the ice pad, and valve 170 is employed. Alternatively, the change in enthalpy of the phase change of the thermal storage medium in ice reservoir 46 may be used to suppress the enthalpy of the coolant that is returned to the chiller at statepoint 1, as when ice reservoir 46 is connected in series downstream of the underfloor cooling loops, as when valve 190 is employed. Where this series operation is employed, whether upstream or downstream, it may be that inlet 154 of valve 150, and outlet 164 of valve 158, may be substantially permanently closed, or, alternatively, valves 150 and 158 may not then require inlet 154 and outlet 164 respectively, and the attaching piping to the "hot" side of the system may be omitted.

In the operation described above, the system may employ a "floating" high pressure on the condensor side, such that the system may adjust the heat rejection temperature at the condensor according to the need for rejected heat to address heating loads in recreational facility 20.

Operation of this apparatus may involve a number of logically related steps. That is, operation may commence at a given time of day. For that time of day the microprocessor in the controller may seek historic data for expected demand in the upcoming time period. It may also determine the state of the "ice reservoir" by polling the temperature sensor in the ice reservoir to determine if the ice reservoir is below, at, or above its phase change plateau. It may poll temperature sensors in the ice pad floor to obtain an indication of ice temperature, and the various temperatures of coolant loops at inlets and outlets from their loads. It may also determine which pumps are "on" and which are "off". Where there is a cooling load, the controller may cause refrigeration apparatus 42 to operate for a period of time until the cooling load reaches a low set point temperature, as may be determined either from values established in memory or that may be keyed in digitally at an input device, or set in an analogue manner using an analogue thermostat. At that time refrigeration apparatus 42 may return to a dormant state, and may remain in a dormant state until the load reaches a higher temperature, at which the refrigeration apparatus may again be activated. This is a simple "On-Off" control mechanism between a pair of high and low set point temperatures, with the output temperature being cycled in a band between the high and low set point temperatures. In a further alternative, a more sophisticated "trend monitoring" system may be used, in which the temperature of the cooling load loop may be sensed over time and compared with the desired set point temperature. The refrigeration systems may then be run faster (or for a longer duty cycle) or slower (or for a shorter duty cycle) depending on the rate of change of the desired output parameter. In either case, the refrigeration apparatus may be used to attend to one load or another load, according to load sharing logic. For example, it may spend 15 minutes per hour cooling one ice pad, another 15 minutes cooling another ice pad, and 30 minutes in a non-operating condition. At other times, under other demand conditions, it may spend 25 minutes on each pad, with a ten minute dwell per hour.

Electronic controller 300 may then assess heating and cooling loads throughout recreational facility 20. Having done so, it may determine the output heat rejection temperature at the thermal equalizer, and may signal the various heat load pumps to operate as may be required. Where there is surplus heat rejection, the controller may cause the closed circuit cooler to operate to soak up the extra rejected heat. Where there is insufficient rejected heat to meet the heating load demand, the controller may cause the supplemental heating element to operate to boost the temperatures in the heating system or systems. Where a larger amount of rejected heat is desired, and before causing the supplemental heating element to operate, the controller may poll the condition of ice reservoir 46, may check against values stored in memory for expected heating demand, and may, if ice reservoir 46 is not fully charged (that is, it is not at or below its low set point temperature, and not at the minimum temperature that can be achieve by refrigeration apparatus 42). Provided that the time of day, and the point in the expected load cycle is appropriate, the controller may then signal refrigeration apparatus 42 to maintain a higher than otherwise high side pressure, with corresponding higher rejection temperature, or it may cause the compressor to run at a higher mass flow rate, while also causing the heating load pumps to operate at a higher flow rate, the net result being a greater rate of heat transfer. Adjustment of the expansion device nozzle may also permit a change in upstream pressure to be obtained. That is, where a specific thermal rejection temperature is desired to achieve, for example, an 80–95 F. temperature in the radiant space heating apparatus, the system may operate both to increase massflow rate of the working fluid in the refrigeration apparatus 42, but, in addition, to choke the system to yield a higher pressure in condensor 76 to give a combination of higher temperature and higher mass flow rate. This may then be accompanied by direction of coolant from the hot side of evaporator 88 to ice reservoir 46. In the event that greater heating is required, and ice reservoir 46 cannot be charged further, electronic controller may signal for supplemental heat at boiler 66.

In the alternate embodiment in which ice reservoir 46 and the underfloor cooling loops may be put in series, controller 300 may cause coolant to flow through ice reservoir 46 and cooling loops 134 while refrigeration apparatus 42 is dormant, or while refrigeration apparatus 42 is running at a reduced mass flow rate, until such time as ice reservoir 46 reaches its high set point temperature. The high set point temperature of ice reservoir 46 may tend to be lower than the desired ice sheet temperature by a few degrees F., or, alternatively, at most, may be at the desired ice sheet temperature, by which point ice reservoir 46 may be considered to be substantially "discharged". At this point, electronic controller 300 may signal for the valves to be repositioned to cause coolant from the hot side of evaporator 88 to flow directly to the underfloor cooling loops 134 as in the usual manner. Further "discharge" of ice reservoir 46 may then also be obtained by setting valves 146 and 150 to admit flow from pump 280 to pass through ice reservoir 46, thereby tending to reduce the cold side inlet temperature at condensor cold side inlet 202. In each case, the use of ice reservoir 46 to reduce the load on compressor 70 (either by providing cooling directly to a load, such as an air conditioning load, and thereby requiring the compressor not to run for a greater period of time, or by reducing the condenser heat rejection inlet temperature, or by permitting an increase in evaporator outlet temperature) may tend to reduce the work input to the system which may typically be provided by either an electrical motor or by a gas or oil fired engine.

In one embodiment, the refrigeration plant (i.e., the ice making equipment lying within the dashed lines of item 110 in FIG. 1*b*) is employed to meet at least 50% of all of the building heating loads of the recreational center, on a year-round basis. In another embodiment, heat rejection from the refrigeration plant is used to meet at least 80% of the building heating loads of the recreational center. In still another embodiment, the refrigeration plant of the ice rink arena is used to meet 100% of the building heating requirements, and may be used to provide surplus heat to an adjacent building or other facility.

Where ice reservoir 46 is used to provide cooling to the condensor side, the freezing point of the thermal storage medium may in some circumstances be in excess of 32 F., but less than the desired heat rejection temperature of the condenser.

In an alternate embodiment, closed circuit cooler 224 may be replaced by an open circuit water cooler 290. In this instance, condenser 76 may be an array of two (or more) plate and frame heat exchangers mounted in parallel, such that one heat exchanger 292 may be cooled by water that is carried to an external cooling tower 294 in an open loop heat rejection system.

In an alternate embodiment, the compressor may be a two stage compressor with an intermediate heat exchanger between the first and second compression stages.

The principles of the present invention are not limited to the specific examples given herein by way of illustration. It is possible to make other embodiments that employ the principles of the invention and that fall within its spirit and scope as defined by the following claims.

We claim:

1. An energy management system including:

refrigeration apparatus;

the refrigeration apparatus including apparatus operable to reject heat;

a refrigeration load ice sheet apparatus connected to the refrigeration apparatus, for cooling thereby to make an ice sheet;

a thermal storage cold sink apparatus, said refrigeration apparatus being connected to cool said thermal storage cold sink apparatus;

a heating load apparatus connected to be heated by heat rejected from the refrigeration apparatus and a load management control system operable at a first time to cause ice to be made at said refrigeration load ice sheet apparatus and to cause heat to be directed from the refrigeration apparatus to the heating load apparatus;

said load management control system being operable at a second time to cause, said thermal storage apparatus to be charged as a cold sink, and to cause heat to be directed from the refrigeration apparatus to the heating load apparatus.

2. A recreational facility comprising:

a refrigeration plant;

an ice sheet pad connected to be cooled by said refrigeration plant;

a thermal energy storage cold sink reservoir connected to be charged by said refrigeration plant;

at least one building heating load element connected to receive heat rejected from said refrigeration plant; and said refrigeration plant being operable to draw heat from either of (a) said ice sheet pad; and (b) said thermal energy cold sink reservoir;

as a source of heat for rejection to said building heating load element.

3. A recreational facility comprising:

a vapour cycle refrigeration plant employing a working fluid;

said vapour cycle refrigeration plant including a compressor, a condenser, an expansion device, and an evaporator operatively connected together;

an ice rink pad;

a thermal energy cold sink storage reservoir;

at least one building heating load element;

a first heat transfer transport medium conduit assembly, said conduit assembly being connected to carry a first heat transfer transport medium between said evaporator and said ice rink pad, and between said evaporator and said thermal energy cold sink storage reservoir;

a second heat transfer transport medium conduit assembly connected to carry a second heat transfer transport medium between said condenser and said building heating load element;

said refrigeration plant being operable to draw heat selectively from either of said ice rink pad and said thermal energy cold sink storage reservoir and to reject heat to said building heating load element;

said working fluid being segregated from said first and second heat transfer transport media; and said first and second heat transfer transport media being different from said working fluid.

4. The recreational facility of claim 3 wherein said working fluid is ammonia.

5. The recreational facility of claim 3 wherein said first and second heat transfer transport media are at least partially glycol.

6. The recreational facility of claim 3 wherein said first and second heat transfer transport media are the same.

7. The recreational facility of claim 3 wherein said first and second heat transfer transport medium conduit assemblies are connected for fluid communication therebetween.

8. The recreational facility of claim 3 wherein one of:

(a) said first heat transfer transport medium conduit assembly;

(b) said second heat transfer transport medium conduit assembly; and (c) said first and second heat transfer transport medium conduit assemblies connected together, includes flow elements operable to direct flow of at least one of said heat transfer transport media between said condenser and said thermal energy cold sink storage reservoir.

9. The recreational facility of claim 3 further comprising fluid flow elements connected to carry heat transfer transport medium flow between said condenser and said thermal energy cold sink storage reservoir.

10. The recreational facility of claim 3 wherein said thermal energy cold sink reservoir includes at least one container holding a thermal storage phase change material, and said first heat transfer transport medium conduit assembly is connected to permit said first heat transfer transport medium to traverse said container.

11. The recreational facility of claim 10 wherein said reservoir includes an array of said containers.

12. The recreational facility of claim 3 wherein heat transfer transport media from either of said first conduit assembly and said second conduit assembly can be directed selectively to engage in heat transfer with said storage reservoir.

13. The recreational facility of claim 3 wherein said facility includes an air conditioning element connected to obtain cooling from said thermal energy cold sink storage reservoir.

14. The recreational facility of claim 13 wherein said air conditioning element is a fan coil unit connected to said cold sink storage reservoir by piping for carrying a heat transfer transport fluid, said fluid being at least partially anti-freeze.

15. The recreational facility of claim 3 further comprising a thermal stratification reservoir for containing a portion of said second heat transfer transport medium, said thermal stratification reservoir having a low outflow port connected to an inlet of said condenser, said condenser having a high return line emptying into said thermal stratification reservoir, and a plurality of said building heating loads being connected to draw a hot portion of said second heat transfer transport medium from said reservoir and to return said portion to said reservoir in a cooler condition.

16. The recreational facility of claim 15 wherein a hot off take manifold is connected to an upper region of said thermal stratification reservoir, and said manifold feeds a plurality of building heating load elements.

17. The recreational facility of claim 3 wherein heat rejection from said refrigeration plant is employed to meet at least 50% of all building heating requirements.

18. The recreational facility of claim 3 wherein heat rejection from said refrigeration plant is employed to meet at least 80% of all building heating requirements.

19. A method of operation of the recreational facility of claim 3, said method comprising the step of operating said refrigeration plant to produce heat for rejection, directing said heat to said building heating load, and charging said cold sink reservoir as a by-product of producing said heat for rejection.

20. The method of operation of claim 19 wherein said method includes the step of cooling said ice rink pad at one time of day while rejecting heat to said building heating load, and the step of charging said cold sink at another time of day.

21. The method of operation of claim 19, and further including the step of discharging said cold sink at another time of day to reduce work input to said compressor.

* * * * *